US006308541B1

(12) United States Patent
Stowe

(10) Patent No.: US 6,308,541 B1
(45) Date of Patent: Oct. 30, 2001

(54) ZIPPER LOCKING DEVICE FOR A LUGGAGE CASE

(76) Inventor: Robert M. Stowe, P.O. Box 425, Goodfield, IL (US) 61742

( * ) Notice: Subject to any disclaimer, the term of this patent is extended or adjusted under 35 U.S.C. 154(b) by 0 days.

(21) Appl. No.: 09/411,872

(22) Filed: Oct. 4, 1999

(51) Int. Cl.[7] ..... E05B 67/38
(52) U.S. Cl. ..... 70/68; 70/312
(58) Field of Search ..... 70/68, 67, 69, 70/70, 71, 72, 73, 74, 75, 312

(56) References Cited

U.S. PATENT DOCUMENTS

| | | | |
|---|---|---|---|
| 1,598,183 | 8/1926 | Whitney . | |
| 1,919,966 | 7/1933 | Taylor . | |
| 2,055,903 | 9/1936 | Kroll | 24/205 |
| 2,741,114 | 4/1956 | Poux | 70/68 |
| 3,319,743 | 5/1967 | Pelavin et al. | 190/41 |
| 3,597,945 | 8/1971 | Feinberg | 70/74 |
| 3,965,706 | 6/1976 | Davis | 70/68 |
| 4,366,684 | 1/1983 | Bako et al. | 70/68 |
| 4,395,891 | 8/1983 | Remington | 70/68 |
| 4,685,315 | 8/1987 | Comolli | 70/68 |
| 4,854,139 | 8/1989 | Scelba | 70/68 |
| 4,856,306 | 8/1989 | Scelba et al. | 70/68 |
| 5,136,864 | 8/1992 | Spiekermann et al. | 70/68 |

*Primary Examiner*—Richard M. Camby
(74) *Attorney, Agent, or Firm*—Mark E. Wiemelt

(57) ABSTRACT

A zipper locking device (10) for securing a double-slider zipper (14) comprising a housing (18), a base (16), a vertically extending member (20), a pivoting arm (22), a pair of compressible pads (26), a stabilizer (24), and a means for locking (34) the device (10). The vertically extending member (20) extends from the base (16) and projects in the upwardly direction through an aperture (54) in the housing (18), allowing for the translational movement of the housing (18) along the vertically extending member (20) between a closed position and an open position. The vertically extending member (20) and the pivoting arm (22) each have an aperture (72, 82), which align to allow the entry of a locking means (34) through the apertures (72, 82) when the zipper locking device (10) is in the closed position. The locking means (34) prevents the translational movement of the housing (18) along the vertically extending member (20), securing the zipper sliders (28) of a double-slider zipper (14) within the housing (18). Removal of the locking means (34) allows for the translational movement of the housing (18) along the vertically extending member (20) and removal or insertion of the zipper sliders (28).

28 Claims, 8 Drawing Sheets

ZIPPER LOCKING DEVICE FOR A LUGGAGE CASE

BACKGROUND OF THE INVENTION

1. Field of the Invention

The present invention relates to a new and improved zipper locking device for a luggage case used to prevent unauthorized access to the interior contents of the luggage case. More specifically, the invention is directed to a removable zipper locking device for use on a luggage case with a double slider zipper, the zipper sliders of each zipper being encased in the zipper locking device in the closed position.

2. Description of the Related Art

Numerous devices have heretofore been proposed for locking zippers on a luggage case in order to protect the interior contents of the luggage case from loss or theft. However, each of the prior art devices have been found wanting in one or more particulars. In particular, these devices have been permanently anchored to the luggage case. These devices could not be removed and used on different pieces of luggage. In addition, in many of the prior art devices, the locking mechanism which is used to secure the device is incorporated into the zipper locking device.

Hence, there is a need in the art for a zipper locking device for a luggage case which is removable from a luggage case and can be used on various different luggage cases. There is also a need in the art for a zipper locking device which is not incorporated with the locking mechanism of the zipper locking device.

It is a primary object of the present invention to provide a new and improved zipper locking device for a luggage case.

A further object of the present invention is to provide an improved zipper locking device for a luggage case which has safety and practical features.

Another object of the instant invention is to provide a zipper locking device for a double slider zipper which encases the zipper sliders and does not leave a gap between the zipper sliders when the zipper is closed.

A further object of the present invention is to provide an improved zipper locking device for a luggage case which is small in size and compact.

Another object of the instant invention is to provide an improved zipper locking device for a luggage case which is removable from a luggage case and usable on different luggage cases.

A further object of the present invention is to provide an improved zipper locking device for a luggage case which is easily attached to zipper sliders and is convenient to use.

Another object of the instant invention is to provide an improved zipper locking device for a luggage case which prevents unauthorized access to the interior contents of the luggage case.

A further object of the present invention is to provide a zipper locking device for a luggage case which incorporates a separate locking mechanism for locking the zipper locking device.

It is therefore an object of the present invention to provide an improved zipper locking device for a luggage case which has all the advantages of the prior art and none of its disadvantages.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

SUMMARY OF INVENTION

A broad aspect of the invention comprises a zipper locking device. One embodiment of the invention utilizes a housing having an aperture and an pair of opposing horizontal indents at the base of the housing, a rectangular base, a vertically extending member having an aperture, the vertically extending member projecting from the base and positioned to extend through the aperture of the housing, two compressible pads mounted to the base, each compressible pad positioned proximate to one of the horizontal indents, an arm pivotally attached to the vertically extending member, the arm having an aperture that aligns with the aperture of the vertically extending member when the device is in the locked position, a stabilizer having an aperture attached to the housing, the aperture of the stabilizer aligned with the aperture of the housing for the passage of the vertically extending member therethrough, and a means for locking the zipper locking device which passes through the aligned apertures of the arm and the vertically extending member.

In the closed position, the housing is lowered. The arm is pivoted in a downwardly direction towards the housing, aligning the apertures of the arm and the vertically extending member and allowing for the passage of a locking means therethrough. In the open position, the locking means is removed, and the arm is pivoted in an upwardly direction away from the housing, misaligning the aperture of the vertically extending member and the aperture of the arm. The housing can then be translated along the vertically extending member in the upwardly direction, allowing for the insertion of a pair of zipper sliders within the zipper locking device.

For this embodiment, it is most advantageous the base be planar and rectangular in shape. It is also beneficial for the sides of the housing to be flush with the sides of the base.

Further embodiments of the invention will be discussed hereafter. Other embodiments of the present invention do not include the pivoting arm or the stabilizer.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
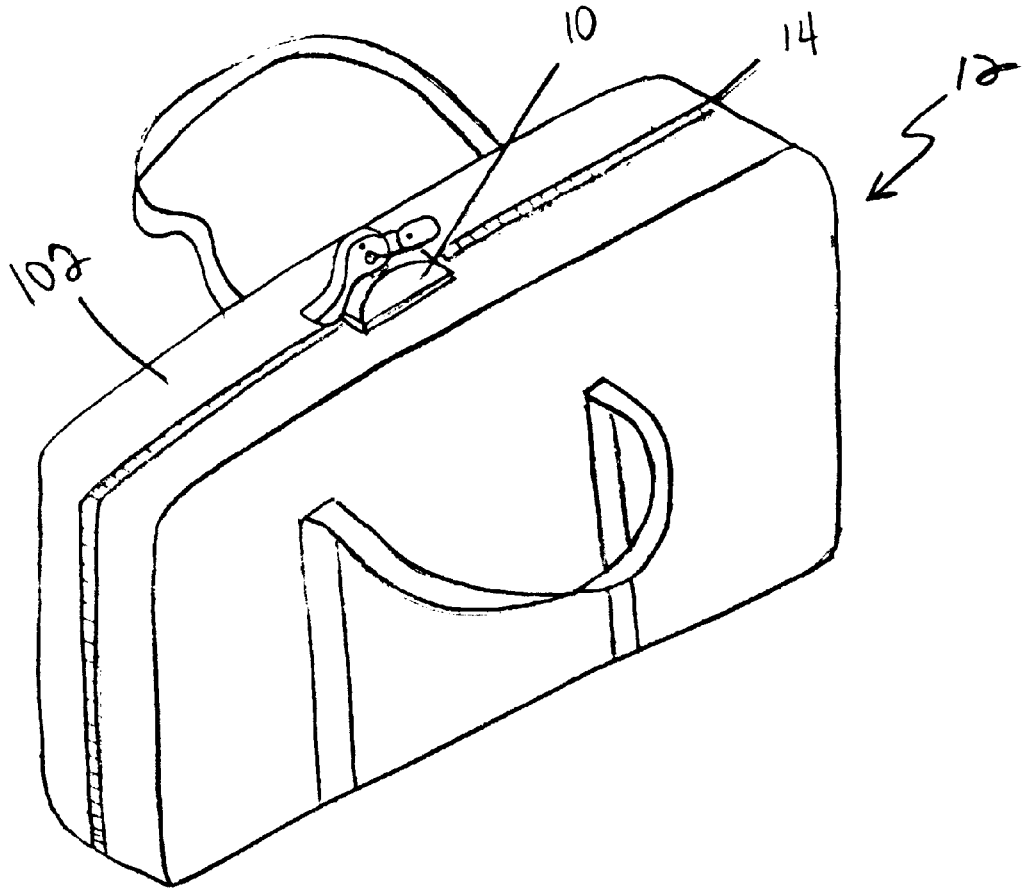
FIG. 1 illustrates a perspective view of the zipper locking device as attached to a luggage case.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the drawings, FIG. 1 illustrates a zipper locking device generally as 10, a luggage case 12, and a double-slider zipper 14. The zipper locking device 10 in this preferred embodiment comprises a base 16, a housing 18, a vertically extending member 20, an arm 22, a stabilizer 24, and a pair of compressible pads 26 (all shown in FIG. 2). The zipper locking device 10 could be made of metal or plastic. It is most preferable that the zipper locking device 10 comprise of a metallic substance.

In the preferred embodiment, the zipper locking device 10 is removably attached to a luggage case 12 which includes a double-slider zipper 14. The double-slider zipper 14 comprises a pair of separate zippers that terminate at the zipper locking device 10. The double-slider zipper 14 includes a pair of zipper sliders 28, a pair of zipper slider pull tabs 30, and a plurality of zipper teeth 32. Each zipper slider 28 has a zipper slider pull tab 30 pivotally attached to the zipper slider 28 which operate the zipper teeth 32 (shown in FIG. 3). As will be described more fully hereinafter, when the zipper locking device 10 is attached to a luggage case 12 with a double slider zipper 14, the zipper sliders 28 and zipper slider pull tabs 30 are encased in the zipper locking device 10, remaining in that position while the zipper locking device 10 is in the (shown in FIG. 4) closed position.

Figure 3:
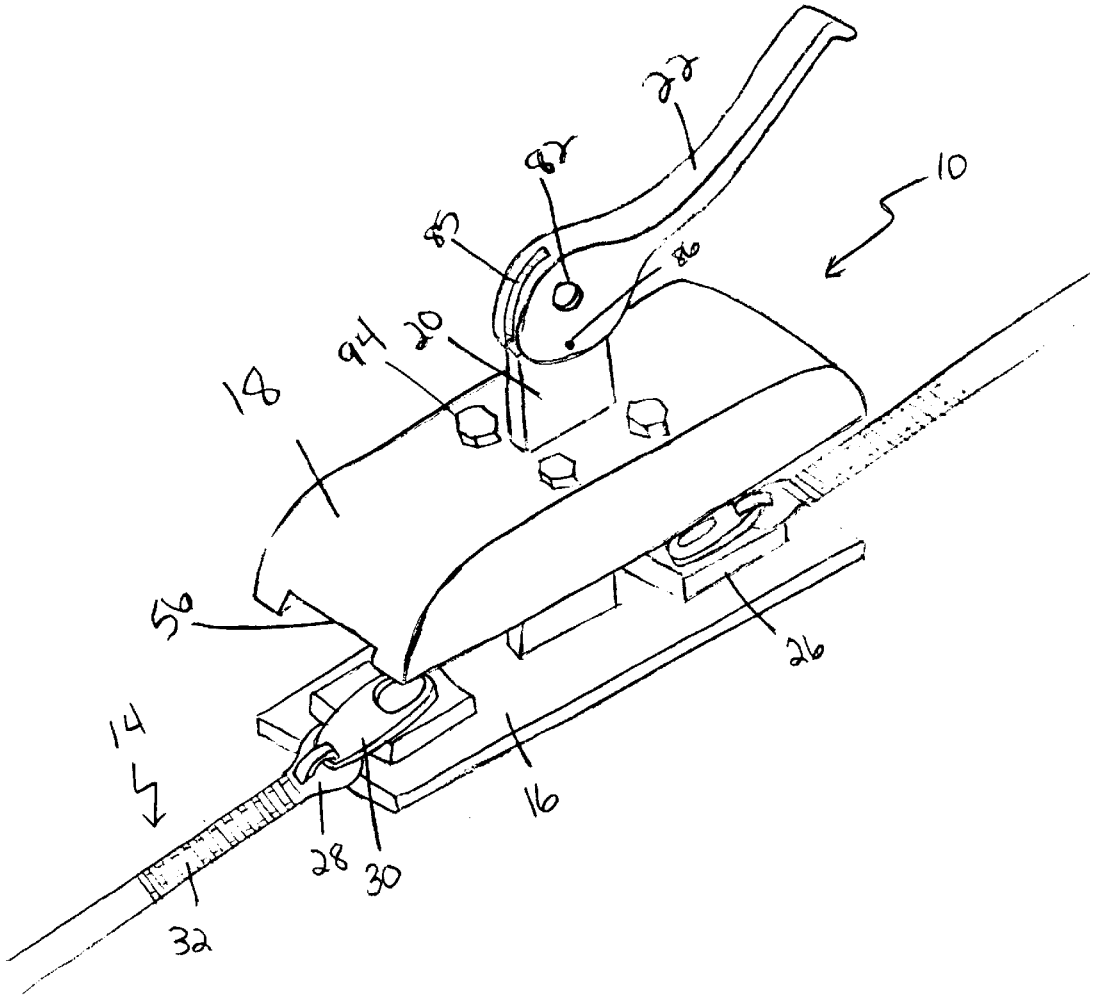
FIG. 3 illustrates a perspective view of the zipper locking device in the open position.
Figure 4:
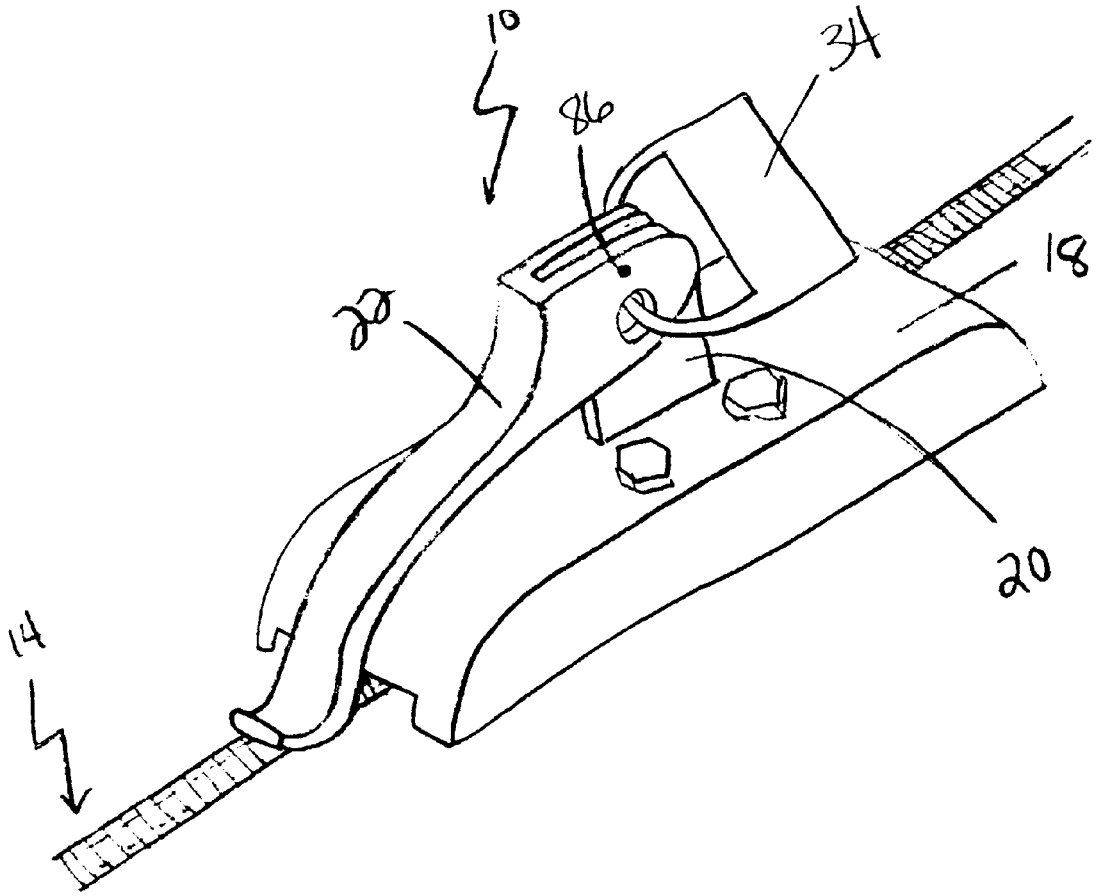
FIG. 4 illustrates a perspective view of the zipper locking device in the closed position.

The zipper locking device 10 translates along the vertically extending member 20 between an open position as shown in FIG. 3 and a closed position as shown in FIG. 4. When the zipper locking device 10 is removably attached to a luggage case 12, the device 10 is in the closed position. In the closed position, a locking means 34 can be inserted in the zipper locking device 10, as shown in FIG. 4. Once the locking means 34 is removed, the housing can translate in an upwardly direction along the vertically extending member 20, resulting in the open position, as shown in FIG. 3. Once the device 10 is in the open position, the zipper sliders 28 and the zipper slider pull tabs 30 of a double slider zipper 14 can be inserted into or removed from the zipper locking device 10. The zipper locking device 10 can then closed by translating the housing 18 in the downwardly direction along the vertically extending member 20 towards the base 16. The housing 18 is translated along the vertically extending member 20 in the upwardly and downwardly direction by a user by engaging fingers of a hand with the housing 18. Further details of the foregoing component parts of the device 10 and their operation will be set forth later.

Figure 2:
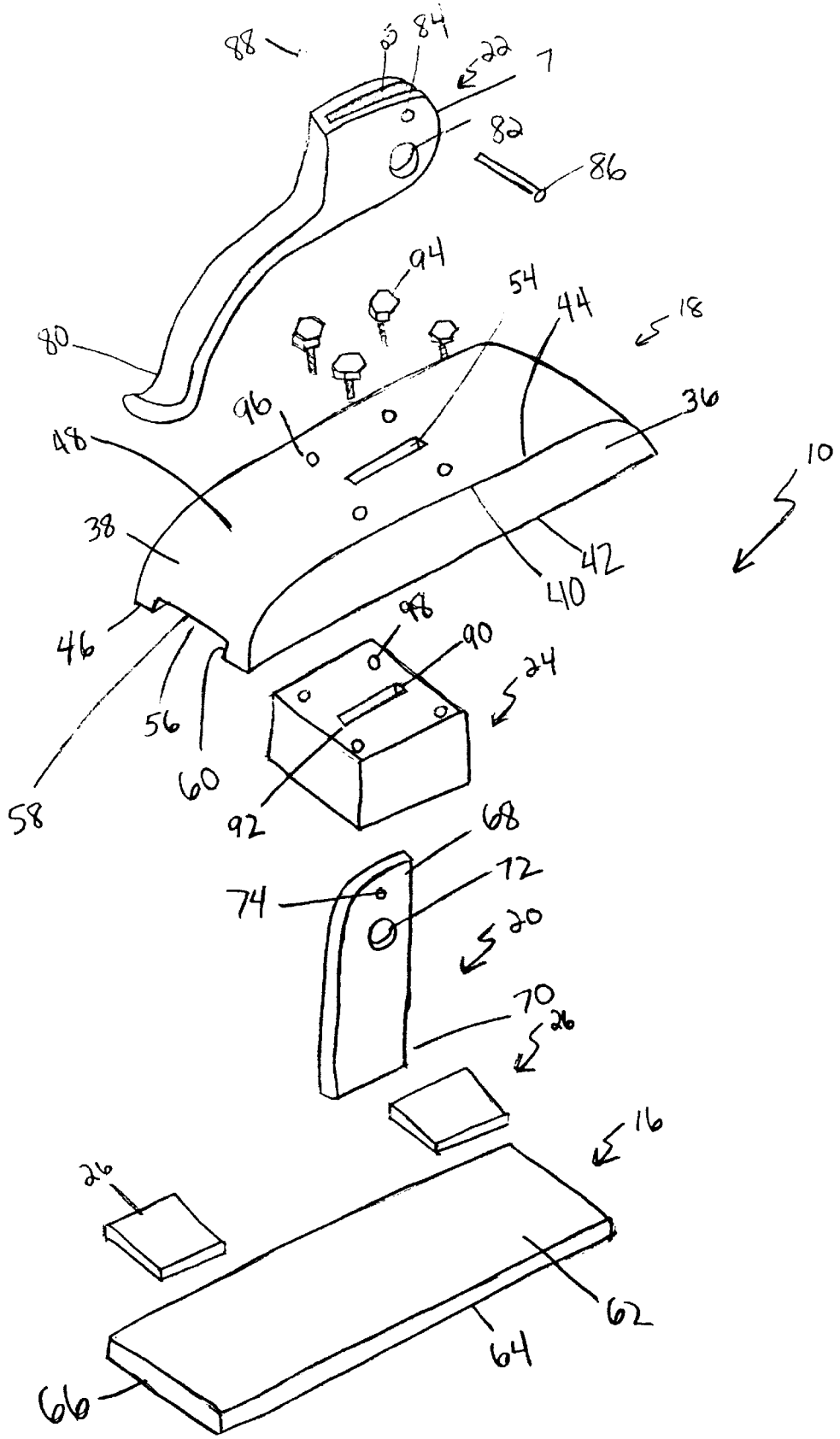
FIG. 2 illustrates an exploded view of the zipper locking device.
Figure 5:
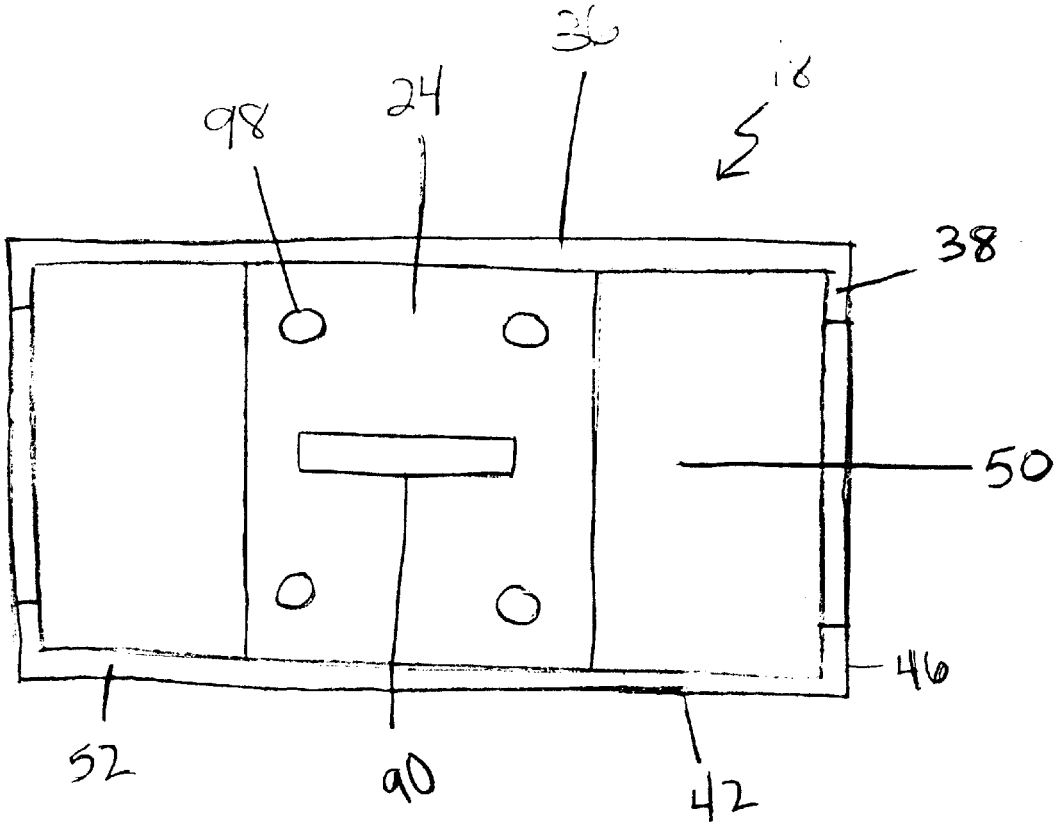
FIG. 5 illustrates a bottom view of the housing of the zipper locking device.

FIG. 2 is an exploded view of the zipper locking device 10. In the preferred embodiment, the housing 18 is a dome like hollow chamber comprised of a pair of parallel side sheets 38 and a top sheet 40. Each side sheet 38 of the housing 18 is planar and substantially semi-oval in shape, with a top edge 40 and a base edge 42. In this embodiment, the top sheet 38 of the housing 18 is most preferably arcuate and substantially rectangular in shape with a pair of side edges 44 and a pair of zipper edges 46. Each side edge 44 of the top sheet 38 of the housing 18 is perpendicularly attached to one of the top edges 40 of one of the side sheets 36 to form the housing 18. Further, the top sheet 38 of the housing 18 should embody a convex outer side 48 and a concave inner side 50 (shown in FIG. 5 and FIG. 8), such that the concave inner side 50 should face the base 16. The housing 18 further comprises a base surface 52 which contacts the luggage case 12 when the zipper locking device 10 is in the closed position.

It will be readily appreciated by those skilled in the art that other suitable shapes of the housing 16 are possible which are consistent with the spirit and scope of the present invention. The housing 16 can be hollow and semi-spherical, semi-elliptical, rectangular or cubical.

The housing 18 further includes an aperture 54 located substantially in the middle of the top sheet 38 of the housing 18 and, in the preferred embodiment, a pair of opposing horizontal indents 56. Each horizontal indent 56 is carved into one of the zipper edges 46 of the top sheet 38 of the housing 18. In this way, the opposing horizontal indents 56 overlay the double-slider zipper 14 when the zipper 14 is locked in the device 10. In the preferred embodiment, the pair of horizontal indents 56 are each substantially rectangular in shape, each having a top edge 58 and a pair of sides edges 60.

It is most preferred that the base 16 is planar and substantially rectangular and have an upper surface 62, a pair of opposing side edges 64 and a pair of opposing zipper edges 66. It will be readily appreciated by those skilled in the art that other suitable shapes of the base 18 are possible which are consistent with the spirit and scope of the present invention. The base 18 could be square, circular, or oval.

In the closed position, the base surface 52 of the housing 18 rests on the upper surface 62 of the base 16 if the device 10 has not been attached to a luggage case 12. It is preferred that the base surface 52 of the housing 18 be the same shape and size as the base 16. In the preferred embodiment, each side sheet 36 of the housing 18 is approximately flush with a side edge 64 of the base 16, and each zipper edge 46 of the top sheet 38 of the housing 18 is approximately flush with a zipper edge 66 of the base 16. However, the alignment of each side sheet 36 of the housing with a side edge 64 of the base 16 and the alignment of each zipper edge 46 of the top sheet 38 of the housing 18 with a zipper edge 66 of the base 16, is not absolutely required.

The vertically extending member 20 has an upper end 68, a lower end 70, an aperture 72, and a hole 74. The lower end 70 of the vertically extending member 20 extends upwardly from and is attached in substantially the middle of the upper surface 62 of the base 16 and is positioned to project through the aperture 54 of the housing 18. The aperture 54 of the housing 18 has sufficient size allow the translation of the vertically extending member 20 therethrough.

The housing 18 translates along the vertically extending member 20 between the open position and the closed position. The housing 18 is raised in the upwardly direction and lowered in the downwardly direction by a user by engaging fingers of a hand with the housing 18. The aperture 72 of the vertically extending member 20 is positioned so that it is proximate to the convex outer side 48 of the top sheet 38 of the housing 18 when the zipper locking device 10 is in the closed position.

The compressible pads 26 are mounted on the upper surface 62 of the base 16, each having an upper surface 76. In the preferred embodiment, the pair of compressible pads 26 are planar and substantially rectangular in shape. The compressible pads 26 can be made of any compressible material, but it is most preferred that the compressible pads 26 comprise of rubber. The compressible pads 26 are mounted on the upper surface 62 of the base 18, preferably by an adhesive 77 (not shown). Each compressible pad 26 is positioned proximate to one of the opposing zipper edges 66 of the base 16. It will be readily appreciated by those skilled in the art that other placements, locations, materials, shapes, and sizes of the compression pads 26 are possible which are consistent with the spirit and scope of the present invention. In an alternate embodiment, the compression pads 26 could be mounted to entire upper surface 62 of the base 18. In other embodiments, the compressible pads 26 could be circular or triangular in shape.

Still referring to FIG. 2, the arm 22 has a pivoting end 78, a housing end 80, an aperture 82, and a hole 84. In the most preferred embodiment, a slot 85 is typically located at the pivoting end 78 of the arm 22, the upper end 68 of the vertically extending member 20 is inserted therewithin. However, the slot 85 at the pivoting end 78 of the arm 22 is not absolutely required.

In this embodiment, the pivoting end 78 of the arm 22 is pivotally attached to the upper end 68 of the vertically extending member 20 by a threaded bolt 86 and a threaded nut 88. The holes 74, 84 of the vertically extending member 20 and the arm 22 are aligned to allow insertion of a threaded bolt 86 therethrough, which is secured by a threaded nut 88. However, it will be readily appreciated by those skilled in the art that other suitable means of pivotal attachment are possible which are consistent with the spirit and scope of the present invention.

When the zipper locking device 10 is in the open position, the apertures 72, 82 of the vertically extending member and the arm 22 are not aligned. When the zipper locking device 10 is in the closed position, the apertures 72, 82 of the vertically extending member 20 and the arm 22 are aligned to allow insertion of a locking means 34 therethrough. In the closed position, the housing end 80 of the arm 22 presses in the downwardly direction to secure the housing 18 and lock the zipper 14.

In the preferred embodiment, a stabilizer 24 includes an aperture 90 and a housing surface 92, the stabilizer 24 being substantially cubical in shape, although other shapes are possible. The housing surface 92 of the stabilizer 24 is attached to the concave inner side 50 of the top sheet 38 of the housing 18. The aperture 90 of the stabilizer 24 is substantially the same size as the aperture 54 of the housing 18, the apertures 54, 90 of the housing 18 and the stabilizer 24 being aligned and of sufficient size as to allow insertion of the vertically extending member 20 therethrough.

The stabilizer 24 and the housing 18 are preferably secured together so that the upper surface 92 of the stabilizer 24 is removably secured to the concave inner side 50 of the top sheet 38 of the housing 18. It is most preferred in this embodiment that the stabilizer 24 have a plurality of holes 96 and that the top sheet 38 of the housing 18 also have a plurality of holes 98. In this way, when the top sheet 38 of the housing 18 overlays upper surface 92 of the stabilizer 24, the plurality of holes 96 and 98 will be aligned for the passage of threaded bolts 94 therethrough. The plurality of threaded bolts 94 are inserted into the plurality of holes 96 and 98 to removably secure the housing 18 and the stabilizer 24 to each other. The exact number of holes 96 and 98 and threaded bolts 94 is not of paramount important, but it is common sensical that the number of threaded holes 96 and 98 should match the number of threaded bolts 94 used therefor.

Figure 8:
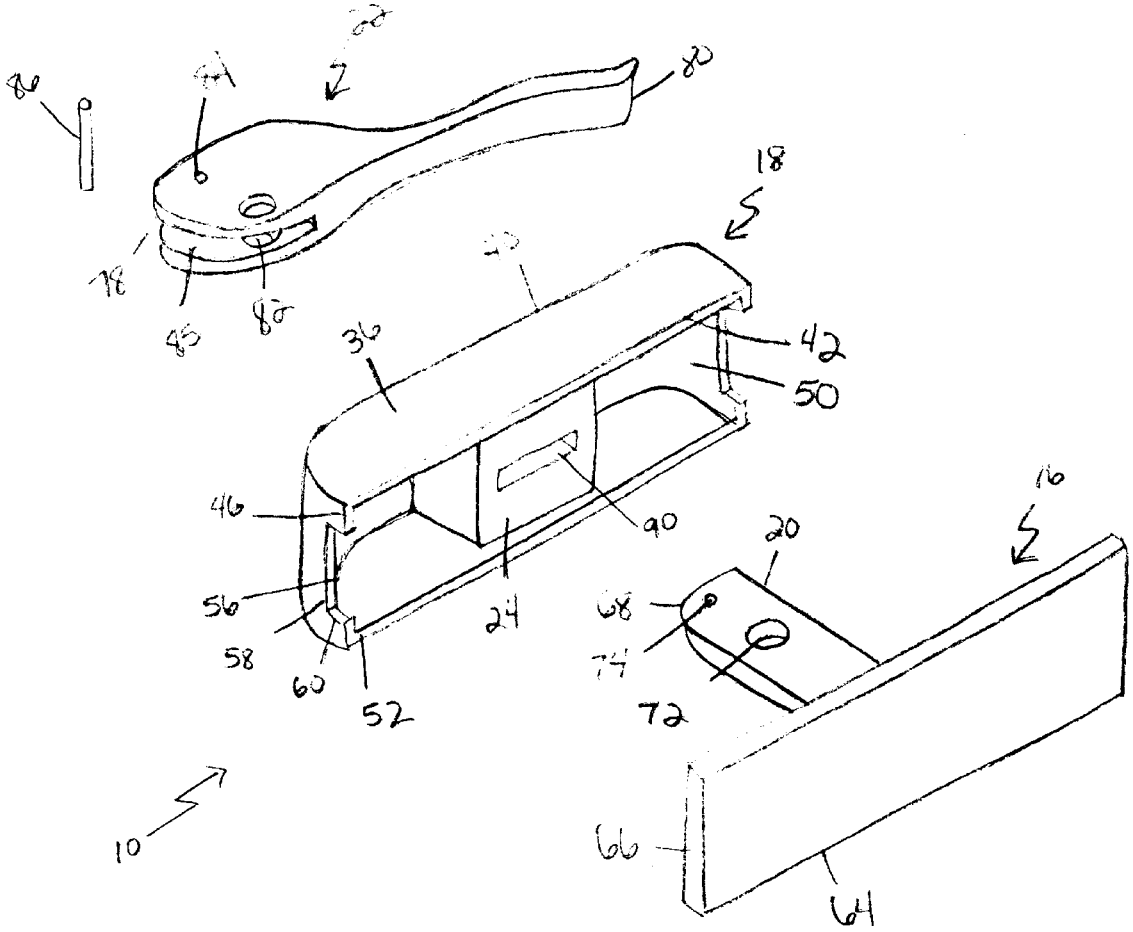
FIG. 8 illustrates an exploded perspective bottom view of the zipper locking device.

FIG. 8 depicts an exploded perspective bottom view of a zipper locking device 10. The upper surface 92 (not shown) of the stabilizer 24 is mounted to the concave inner side 50 of the top sheet 38 of the housing 10. The vertically extending member 20 projects from the base 16 and through the apertures 54 (not shown), 90 of the stabilizer 24 and the housing 18.

FIG. 3 depicts the open position of the zipper locking device 10 attached to a luggage case 12 with the zipper teeth 32 of the zipper 14 engaged with each other, the base 16 of the device 10 still in view. In the open position, after the locking means 34 is removed, the housing 18 is lifted off along the vertically extending member 20 towards its upper end 68 by a user by engaging fingers of hand with the housing 18. The base 16 of the zipper locking device 10 can then be inserted inside an almost entirely zipped luggage case 12, the upper surface 62 of the base 16 contacting the interior surface 100 (not shown) of the luggage case 12. The zipper sliders 28 and the zipper slider pull tabs 30 of the zipper 14 are pulled towards the vertically extending member 20 of the open device 10 by a user by engaging fingers of the hand with the zipper slider pull tabs 30. The zipper slider pull tabs 30 can be pulled until the zipper sliders 28 are positioned approximately on the compressible pads 26 proximate to the vertically extending member 20, the zipper slider pull tabs 30 pivoted distal to the vertically extending member 20. Once the housing 18 is lowered, the zipper locking device 10 is in the closed position.

Figure 6:
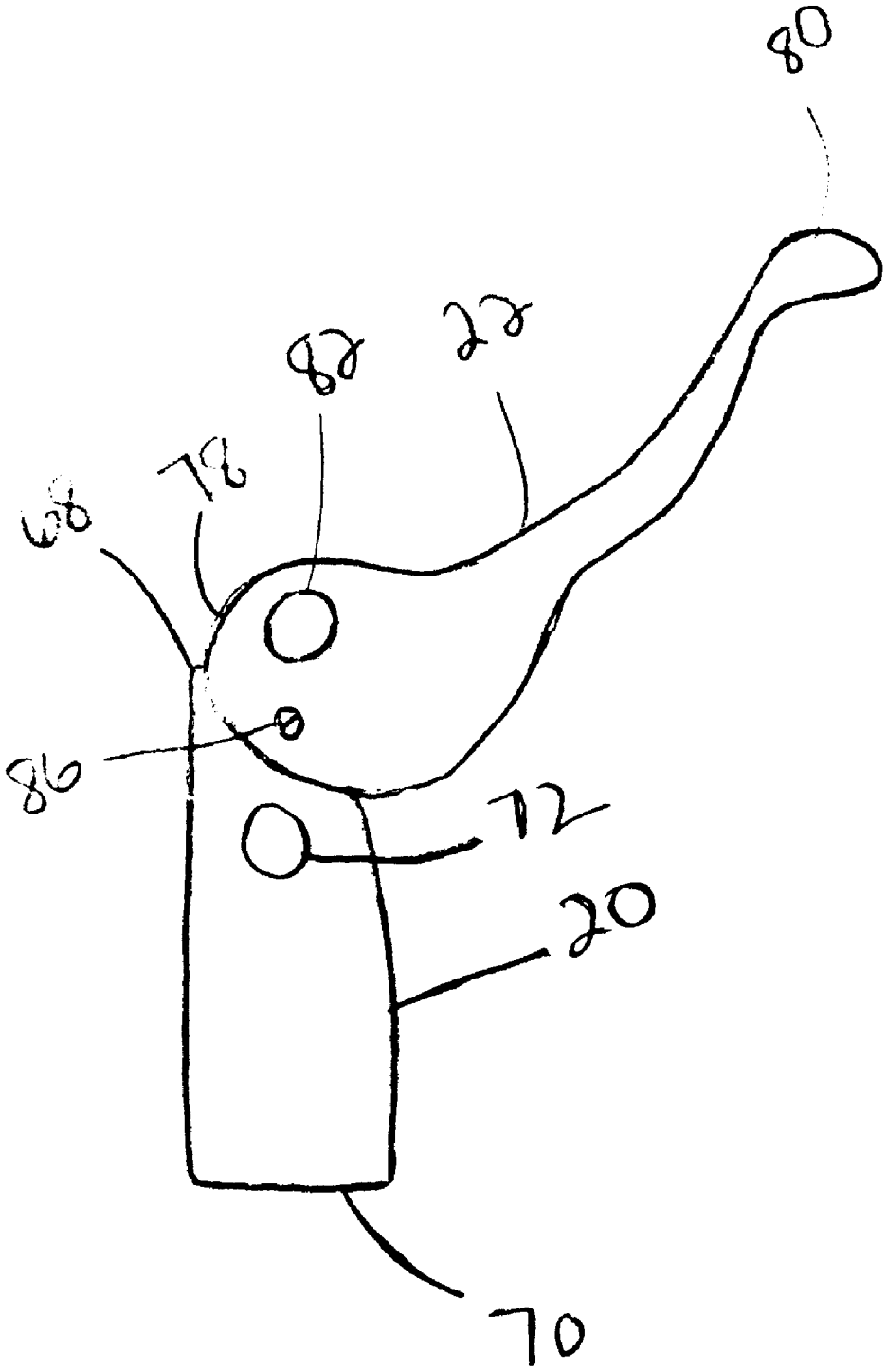
FIG. 6 illustrates a side view of the vertically extending member and the pivoting arm when the zipper locking device is in the open position.

In the open position, the arm 22 is pivoted upwards away from the housing 18. In the open position, the apertures 72, 82 of the arm 22 and the vertically extending member 20 (see FIG. 6) are not aligned. In this position, the housing 16 is capable of translating in the upwardly and downwardly direction along the vertically extending member 20.

Figure 7:
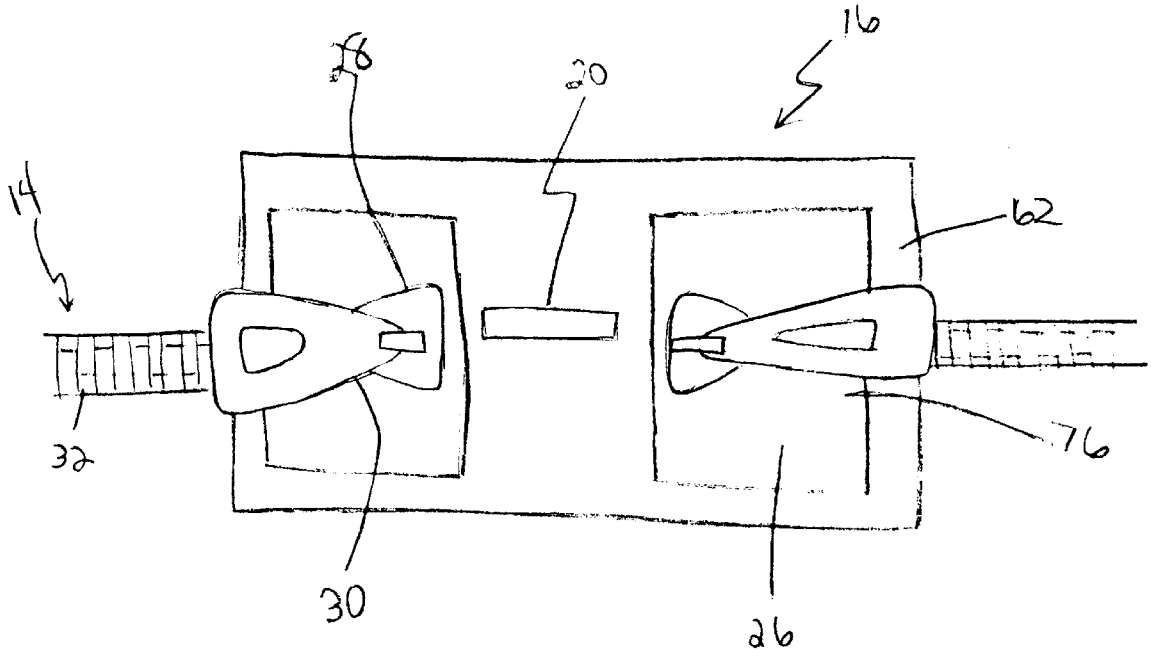
FIG. 7 illustrates a top view of the base of the zipper locking device with the zipper sliders and zipper slider pull tabs inserted in the zipper locking device.

As shown in FIG. 4, when the zipper locking device 10 is attached to a luggage case 12, the housing 18 is lowered and released by a user by disengaging fingers of a hand so that the base surface 52 of the housing 18 contacts the exterior surface 102 of the luggage case 12. When the housing 18 is lowered and the device 10 is in the closed position, the zipper sliders 28 and the zipper slider pull tabs 30 are encased within the housing 18 to secure the zipper teeth 32 (as shown in FIG. 7) from disengagement from each other. Each zipper slider 28 is positioned so that each is located on the upper surface 76 of one of the compressible pads 26. Once the housing 18 is lowered, each zipper 14 is trapped between the upper surface 76 of one of the compressible pads 26 and the top edge 58 of one of the opposing horizontal indents 56 of the housing 18.

Once the housing 18 is lowered, the arm 22 is pivoted in the downwardly direction so that the housing end 80 of the arm 22 contacts the outer surface 48 of the top sheet 38 of the housing 18, in order to secure the device 10 in the closed position. In addition, the arm 22 is pivoted in the downwardly direction so that the apertures 72, 82 of the vertically extending member 20 and arm 22 are aligned to allow the passing of a locking means 34 therethrough. In the preferred embodiment, the locking means 34 is a padlock. After the addition of the locking means 34, the arm 22 cannot pivot and the housing 18 is prohibited from translating along the vertically extending member 20. The zipper sliders 28 and the zipper slider pull tabs 30 are locked within the zipper locking device 10 until the device is operated in the manner previously described to permit the translation of the housing 18 and thereafter the release of the zipper sliders 28 and the zipper slider pull tabs 30 and the disengagement of the plurality of zipper teeth 32.

Once the zipper locking device 10 is attached to a luggage case 12, as shown in FIG. 1, its novel advantages will become apparent. For one, the present invention secures the zipper 14 of a luggage case 12 and prevents the disengagement of the zipper teeth 32 from each other. Thus employed, the zipper teeth 32 remain engaged, preventing the unauthorized access of the interior contents (not shown) of the luggage case 12. Also, the zipper locking device 10 is removably attached to the luggage case 12, allowing the device 10 to be usable on various different luggage cases 12. This is favorable over prior art zipper locking devices which are permanently attached to a luggage case and cannot be removed for use on other luggage cases 12. Additionally, the locking means 34 is not incorporated into the zipper locking device 10, allowing the alternation of various different locking means 34 and locking devices.

Another embodiment of the present invention does not include an arm 22 pivotally attached to the vertically extending member 20. In this embodiment, the aperture 42 of the vertically extending member 20 allows for the entry of a locking means 34 therethrough. The locking means 34 prevents the translation of the housing 18 in the upwardly and downwardly direction along the vertically extending member 20. In this embodiment, in the closed position, the aperture 42 of the vertically extending member 20 should be substantially proximate to the outer surface 48 of the top sheet 38 of the housing 18. In another embodiment of the instant invention, the device 10 does not include a stabilizer 24 attached to the inner surface 50 of the top sheet 38 of the housing 18.

While the invention has been described in connection with a preferred embodiment and several alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing discussion is illustrative of the invention. However, since many embodiments of the invention can be made without departing from the spirit and scope of the invention, the invention resides wholly in the claims hereinafter appended.

I claim:

1. A removable zipper locking device for enclosing a pair of zipper sliders, the zipper locking device comprising:

a. a housing having an concave inner side, an convex outer side, a base surface, an aperture, and a pair of opposing zipper edges, the opposing zipper edges each including an indent being carved at each zipper edge;

b. a base having an upper surface and a pair of opposing zipper edges;

c. a vertically extending member having an upper end, a lower end, and a aperture positioned substantially proximate to the convex outer side of the housing when the zipper locking device is in the closed position, the lower end of the vertically extending member affixed to the upper surface of the base, wherein the vertically extending member projects from the upper surface of the base and is positioned to project through the aperture in the housing;

d. a means for securing the zipper sliders within the zipper locking device;

e. a means for locking the zipper locking device, whereby the zipper locking device locks the pair of zipper sliders substantially proximate to one another when the zipper locking device is in a closed position, the pair of zipper sliders operating a plurality of zipper teeth and each having a zipper slider pull tab.

2. The zipper locking device as recited in claim 1, wherein the means for securing the zipper sliders within the zipper locking device comprising at least one compressible pad mounted to the upper surface of the base, at least one compressible pad positioned proximate to the pair of opposing zipper edges of the base.

3. The zipper locking device as recited in claim 1 further comprising an arm having a pivoting end and an aperture positioned proximate to the pivoting end, the pivoting end of the arm pivotally attached by an attachment means to the upper end of the vertically extending member, the aperture of the arm aligning with the aperture of the vertically extending member in the closed position and not aligning in the open position.

4. The zipper locking device as recited in claim 3 wherein the vertically extending member further comprises a hole and the arm further comprises a hole, the hole of the vertically extending member and the hole of the arm being aligned and the attachment means passing therethrough, the attachment means comprising a threaded bolt and a threaded nut.

5. The zipper locking device as recited in claim 1 further comprising a stabilizer attached to the concave inner side of the housing, the stabilizer having an aperture substantially the same size as the aperture of the housing, the aperture of the stabilizer and the aperture of the housing being aligned and the vertically extending member passing therethrough.

6. The zipper locking device as recited in claim 1 wherein the base and the base surface of the housing are substantially rectangular in shape.

7. The zipper locking device as recited in claim 1 wherein the locking means passes through the aperture of the vertically extending member and the aperture of the arm, being aligned, when the zipper locking device is in the closed position.

8. The zipper locking device as recited in claim 7 wherein the locking means is a padlock.

9. A removable zipper locking device for enclosing a pair of zipper sliders, the zipper locking device comprising:

a. a housing having an concave inner side, an convex outer side, a base surface, an aperture, and a pair of opposing zipper edges, the opposing zipper edges each including an indent being carved at each zipper edge;

b. a base having an upper surface and a pair of opposing zipper edges;

c. a vertically extending member having an upper end, a lower end, and a aperture positioned substantially proximate to the convex outer side of the housing when the zipper locking device is in the closed position, the lower end of the vertically extending member affixed to the upper surface of the base, wherein the vertically extending member projects from the upper surface of the base and is positioned to project through the aperture in the housing;

d. a means for securing the zipper sliders within the zipper locking device;

e. an arm having a pivoting end and an aperture positioned proximate to the pivoting end, the pivoting end of the arm pivotally attached by an attachment means to the upper end of the vertically extending member, the aperture of the arm aligning with the aperture of the vertically extending member in the closed position and not aligning in the open position; and f. a means for locking the zipper locking device, whereby the zipper locking device locks the pair of zipper sliders substantially proximate to one another when the zipper locking device is in a closed position, the pair of zipper sliders operating a plurality of zipper teeth and each having a zipper slider pull tab.

10. The zipper locking device as recited in claim 9, wherein the means for securing the zipper sliders within the zipper locking device comprising at least one compressible pad mounted to the upper surface of the base, at least one compressible pad positioned proximate to the pair of opposing zipper edges of the base.

11. The zipper locking device as recited in claim 9 wherein the vertically extending member further comprises a hole and the arm further comprises a hole, the hole of the vertically extending member and the hole of the arm being aligned and the attachment means passing therethrough, the attachment means comprising a threaded bolt and a threaded nut.

12. The zipper locking device as recited in claim 9 further comprising a stabilizer attached to the concave inner side of the housing, the stabilizer having an aperture substantially the same size as the aperture of the housing, the aperture of the stabilizer and the aperture of the housing being aligned and the vertically extending member passing therethrough.

13. The zipper locking device as recited in claim 9 wherein the base and the base surface of the housing are substantially rectangular in shape.

14. The zipper locking device as recited in claim 9 wherein the locking means passes through the aperture of the vertically extending member and the aperture of the arm, being aligned, when the zipper locking device is in the closed position.

15. The zipper locking device as recited in claim 14 wherein the locking means is a padlock.

16. A removable zipper locking device for enclosing a pair of zipper sliders, the zipper locking device comprising:

a. a housing having an concave inner side, an convex outer side, a base surface, an aperture, and a pair of opposing zipper edges, the opposing zipper edges each including an indent being carved at each zipper edge;

b. a base having an upper surface and a pair of opposing zipper edges;

c. a vertically extending member having an upper end, a lower end, and a aperture positioned substantially proximate to the convex outer side of the housing when the zipper locking device is in the closed position, the lower end of the vertically extending member affixed to the upper surface of the base, wherein the vertically extending member projects from the upper surface of the base and is positioned to project through the aperture in the housing;

d. a means for securing the zipper sliders within the zipper locking device;

e. a stabilizer attached to the concave inner side of the housing, the stabilizer having an aperture substantially the same size as the aperture of the housing, the aperture of the stabilizer and the aperture of the housing being aligned and the vertically extending member passing therethrough; and f. a means for locking the zipper locking device, whereby the zipper locking device locks the pair of zipper sliders substantially proximate to one another when the zipper locking device is in a closed position, the pair of zipper sliders operating a plurality of zipper teeth and each having a zipper slider pull tab.

17. The zipper locking device as recited in claim 16, wherein the means for securing the zipper sliders within the zipper locking device comprising at least one compressible pad mounted to the upper surface of the base, at least one compressible pad positioned proximate to the pair of opposing zipper edges of the base.

18. The zipper locking device as recited in claim 16 further comprising an arm having a pivoting end and an aperture positioned proximate to the pivoting end, the pivoting end of the arm pivotally attached by an attachment means to the upper end of the vertically extending member, the aperture of the arm aligning with the aperture of the vertically extending member in the closed position and not aligning in the open position.

19. The zipper locking device as recited in claim 18 wherein the vertically extending member further comprises a hole and the arm further comprises a hole, the hole of the vertically extending member and the hole of the arm being aligned and the attachment means passing therethrough, the attachment means comprising a threaded bolt and a threaded nut.

20. The zipper locking device as recited in claim 16 wherein the base and the base surface of the housing are substantially rectangular in shape.

21. The zipper locking device as recited in claim 16 wherein the locking means passes through the aperture of the vertically extending member and the aperture of the arm, being aligned, when the zipper locking device is in the closed position.

22. The zipper locking device as recited in claim 21 wherein the locking means is a padlock.

23. A removable zipper locking device for enclosing a pair of zipper sliders, the zipper locking device comprising:

a. a housing having an concave inner side, an convex outer side, a base surface, an aperture, and a pair of opposing zipper edges, the opposing zipper edges each including an indent being carved at each zipper edge;

b. a base having an upper surface and a pair of opposing zipper edges;

c. a vertically extending member having an upper end, a lower end, and a aperture positioned substantially proximate to the convex outer side of the housing when the zipper locking device is in the closed position, the lower end of the vertically extending member affixed to the upper surface of the base, wherein the vertically extending member projects from the upper surface of the base and is positioned to project through the aperture in the housing;

d. a means for securing the zipper sliders within the zipper locking device;

e. an arm having a pivoting end and an aperture positioned proximate to the pivoting end, the pivoting end of the arm pivotally attached by an attachment means to the upper end of the vertically extending member, the aperture of the arm aligning with the aperture of the vertically extending member in the closed position and not aligning in the open position;

g. a stabilizer attached to the concave inner side of the housing, the stabilizer having an aperture substantially the same size as the aperture of the housing, the aperture of the stabilizer and the aperture of the housing being aligned and the vertically extending member passing therethrough; and h. a means for locking the zipper locking device, whereby the zipper locking device locks the pair of zipper sliders substantially proximate to one another when the zipper locking device is in a closed position, the pair of zipper sliders operating a plurality of zipper teeth and each having a zipper slider pull tab.

24. The zipper locking device as recited in claim 23, wherein the means for securing the zipper sliders within the zipper locking device comprising at least one compressible pad mounted to the upper surface of the base, at least one compressible pad positioned proximate to the pair of opposing zipper edges of the base.

25. The zipper locking device as recited in claim 23 wherein the vertically extending member further comprises a hole and the arm further comprises a hole, the hole of the vertically extending member and the hole of the arm being aligned and the attachment means passing therethrough, the attachment means comprising a threaded bolt and a threaded nut.

26. The zipper locking device as recited in claim 23 wherein the base and the base surface of the housing are substantially rectangular in shape.

27. The zipper locking device as recited in claim 23 wherein the locking means passes through the aperture of the vertically extending member and the aperture of the arm, being aligned, when the zipper locking device is in the closed position.

28. The zipper locking device as recited in claim 27 wherein the locking means is a padlock.

* * * * *